United States Patent [19]

Kupersmit

[11] Patent Number: 4,595,137

[45] Date of Patent: Jun. 17, 1986

[54] REINFORCING ELEMENT FOR COLLAPSIBLE CONTAINER

[76] Inventor: Julius B. Kupersmit, 299 W. 12th St., New York, N.Y. 10014

[21] Appl. No.: 745,785

[22] Filed: Jun. 17, 1985

[51] Int. Cl.[4] ..... B65D 5/58

[52] U.S. Cl. ..... 229/41 R; 229/23 BT; 229/DIG. 1; 220/441

[58] Field of Search ..... 220/6, 73, 410, 441, 220/470; 229/23 BT, 41 R, 45 R, DIG. 1

[56] References Cited

U.S. PATENT DOCUMENTS

| | | | |
|---|---|---|---|
| 3,072,313 | 1/1963 | Svendsen | 229/DIG. 1 X |
| 3,613,985 | 10/1971 | Goodsite | 229/DIG. 1 X |
| 3,643,856 | 2/1972 | Jones | 220/441 X |
| 3,734,389 | 5/1973 | Brown | 229/DIG. 1 X |
| 3,929,273 | 12/1975 | Swanson | 229/23 BT X |
| 4,087,041 | 5/1978 | Centanni | 220/441 |
| 4,260,071 | 4/1981 | Bamburg et al. | 229/DIG. 1 X |
| 4,402,452 | 9/1983 | Kupersmit | 229/41 R |
| 4,405,077 | 9/1983 | Kupersmit | 229/41 R |
| 4,411,373 | 10/1983 | Kupersmit | 229/41 R X |

*Primary Examiner*—Steven M. Pollard
*Attorney, Agent, or Firm*—Charles E. Temko

[57] ABSTRACT

A collapsible shipping container of a type which includes a foldable reinforcing element which is stored in the collapsed condition when not in use. The container is of substantially square dimensions in a horizontal plane, and the reinforcing element includes provision for disassembly prior to folding so as to be accomodated in substantially congruent relation upon an upper surface of a bottom wall of the container.

2 Claims, 6 Drawing Figures

REINFORCING ELEMENT FOR COLLAPSIBLE CONTAINER

BACKGROUND OF THE INVENTION

This invention relates generally to the field of collapsible shipping containers of a type including a folding reinforcing element which adds rigidity to the container body when in erected condition to increase stacking capacity, and reduce bulging between the vertical corners thereof. Devices of this general type are well known in the art, and the invention lies in specific constructional details which permit the dimensioning of the container to a required shape. Reference is made to my prior U.S. Pat. Nos. 4,402,452 of Sept. 6, 1983; U.S. Pat. No. 4,411,373 of Oct. 25, 1983; and U.S. Pat. No. 4,405,077 of Sept. 20, 1983, all of which disclose structures of this general type.

In certain industries, and particularly in the case of containers which are employed in foreign commerce, there has arisen the need for containers which offer the benefits of structures described in the above-mentioned patents, which are of particular established dimensions resulting in a corresponding rectangular configuration. My prior U.S. Pat. No. 4,405,077 deals with the provision of a relatively tall container, and the problems of providing a folding configuration such that the collapsed side walls will not overlie the bottom wall.

In erected condition, the reinforcing element must be of such dimensions that it substantially overlies the erected side walls and end walls of the container from bottom to top edges, as well as provide suitable corner reinforcement to provide greater compressive strength. The provision of such a liner does not provide difficulty when in erected condition. The folding of a relatively larger reinforcing element for storage upon a relatively small bottom wall without overlying the same, in the case of a relatively tall container, can impose substantial design problems. This is particularly true in the case of a container of almost any height, in which the side and end walls thereof are of substantially similar width. Where the reinforcement element is made as an integrated structure, it usually becomes impossible to fold the same in any convenient manner to achieve this purpose.

SUMMARY OF THE INVENTION

Briefly stated, the invention contemplates the provision of an improved collapsible container reinforcing element of the class described, in which the above-mentioned problems have been substantially eliminated. To this end, the reinforcing element is formed as a pair of separable elements, each including a rectangular side wall, and rectangular end walls of substantially half the width of the side walls which in erected condition are selectively interconnectible to form a relatively rigid rectangular structure, and which may be conveniently separated to be subsequently folded to generally planar condition for storage to occupy a relatively small area no larger than that of the side wall. To this end, the separable members are provided with a tongue and groove construction which, when interconnected, provide the equivalent of a permanently laminated multiply reinforcing wall along each end wall. The tongue and groove construction is preferably frictionally retained in engagement, so that it may be separated without the use of tools or by those possessed of only ordinary skill.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
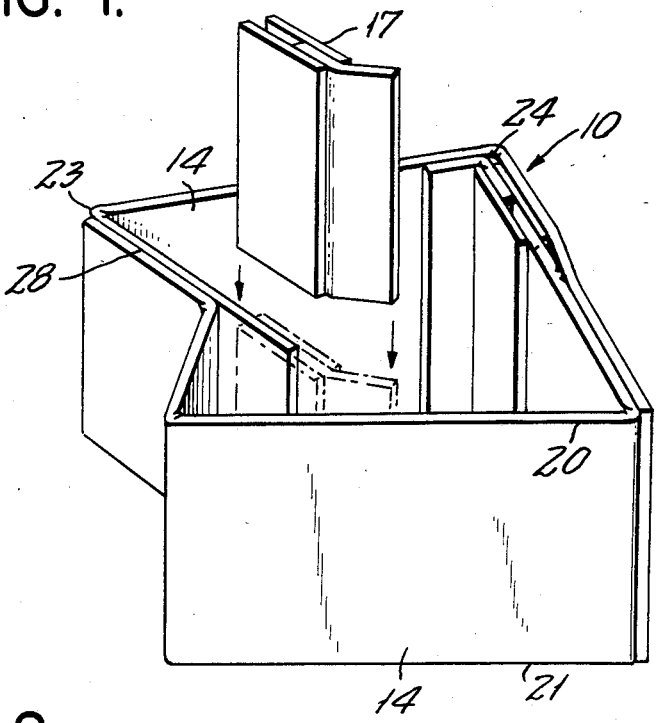
FIG. 1 is an exploded view in perspective of a reinforcing liner in accordance with the disclosed invention.

In accordance with the invention, the device, generally indicated by reference character 10, comprises broadly, first and second interconnected elements 11 and 12, each being formed from double ply corrugated board, and glued together in such manner as to permit the same to be collapsed to generally planar condition when not in use.

Figure 3:
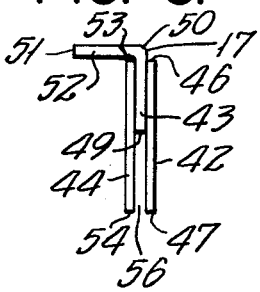
FIG. 3 is a top plan view of a separable member forming a part of the embodiment, and corresponding to the upper right-hand portion of FIG. 2.
Figure 4:
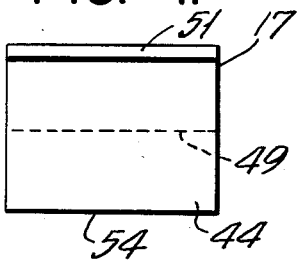
FIG. 4 is a side elevational view thereof as seen from the left-hand portion of FIG. 3.

Each of the elements 11 and 12 include a relatively rigid side wall 14, a first partial end wall 15, and a second full end wall 16, as well as a separable member 17 (FIGS. 3 and 4).

Figure 5:
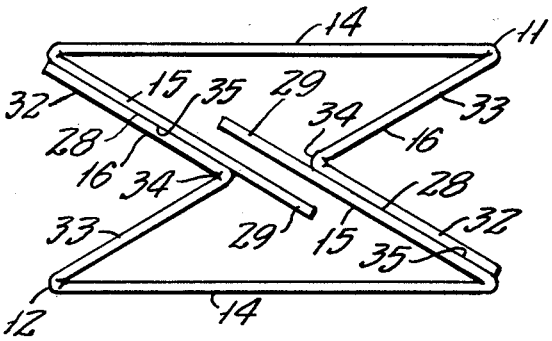
FIG. 5 is a top plan view showing partial collapse of the reinforcing liner after separation of the separable members shown in FIGS. 3 and 4.
Figure 6:
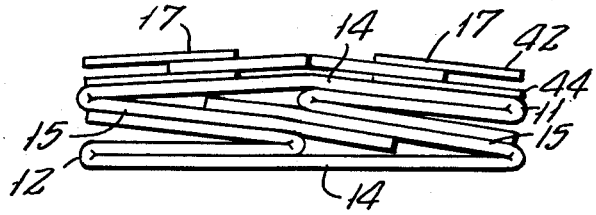
FIG. 6 is a top plan view of the embodiment in fully folded condition and ready for storage.

Referring to FIG. 1, the device in erected condition is bounded by a continuous upper edge 20 and a continuous lower edge 21. The rigid side wall 14 is also bounded by first and second vertical fold lines 23 and 24. The first partial end wall 15 is of a length less than that of the second end wall 16, and the outer surface thereof includes a glued area 28 and a free area 29 (See FIG. 5). The end wall 16 is formed to included first and second foldable portions 32 and 33 interconnected by a vertical fold line 34. Only the first portion 32 is glued at surface 35 to the partial end wall 15 to permit the same to be folded as shown in FIG. 5, and completely collapsed as shown in FIG. 6.

Figure 2:
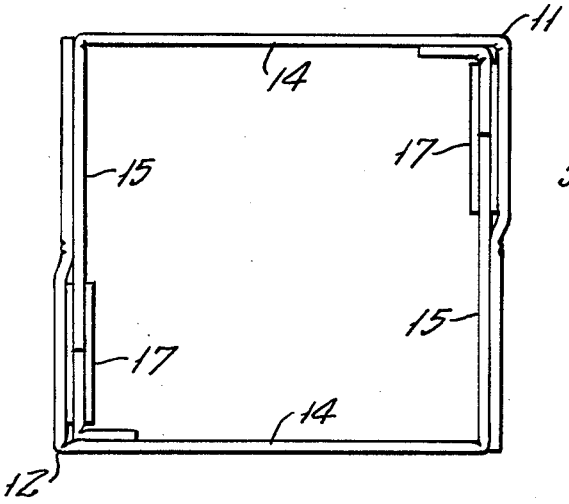
FIG. 2 is a top plan view thereof in erected condition ready for use within a container.

Referring to FIG. 3, the separable members 17 are substantially identical, and are of laminated double ply construction. Each includes an outer ply 42, a medially disposed ply 43, and an inner ply 44. The outer ply 42 is bounded by first and second vertical edges 46 and 47, respectively. The medially disposed ply 43 is bounded by a first vertical edge 49, a vertical fold line 50 and a second vertical edge 51 to form a foldable flap 52 which provides additional reinforcement in two oppositely dispose corners of the device. The inner ply 44 is bounded by first and second vertical edges 53 and 54. As best seen in FIG. 3, the plies 42–44 are positioned in staggered relations so as to form a medially disposed recess 56 selectively slidably engaged with that part of the respective wall 15 which is free of glued interconnection, as best seen in FIGS. 1 and 2. Preferably, the engagement is such as to provide frictional retention, although this can be supplemented by removable fastening means (not shown) if considered desirable.

Operation of the device 10 will be apparent from a consideration of the drawing. Starting from fully opened or erected condition as indicated in FIG. 2, the device is collapsed by first removing the separable members 17 as shown in FIG. 1, which will permit the remaining portions of the device to be folded as shown in FIG. 5, and ultimately compressed to generally planar condition as shown in FIG. 6. The removed separable members may be placed in generally flattened condition as shown in the upper portion of FIG. 6, following which the entire device may be positioned within the lower portion of a collapsed container (not shown) in known manner.

It will be observed that in prior constructions illustrated in my above-mentioned prior patents, the rigid side wall 14 is of considerably longer dimension than the end walls 15 and 16, so that the need for separable members 17 is not present. My present construction is particularly suitable where the side and end walls are of substantially similar length, to form a relatively square configuration as shown in FIG. 2.

I wish it to be understood that I do not consider the invention limited to the precise details of structure shown and set forth in this specification, for obvious modifications will occur to those skilled in the art to which the invention pertains.

I claim:

1. An improved foldable reinforcing liner for use with a collapsible reusable shipping container comprising: first and second wall elements, each of said wall elements including a side wall and first and second end walls foldably interconnected to said side wall at opposite ends thereof; said end walls, in erected position, being positioned at substantially a right angle relative to a respective side wall; said first end walls of each of said wall elements including first and second mutually foldable portions interconnected by a fold line; said second end walls of each of said wall elements being relatively rigid and being interconnected to a first end wall of the other of said wall elements only over an abutting surface of one of said first and second foldable portions, leaving the remainder of said second end walls free of interconnection and terminating in a free edge; each of said wall elements having a multiply separable member including first, second and third laminae interconnected in mutually staggered relation to define a recess; said remainder of said second end walls forming a tongue which is slidably engageable within a respective recess to effectively increase the length of said second end walls to that of said first end walls when said reinforcing liner is in use, and being removable to permit the collapsing of said liner without interference for storage.

2. A reinforcing liner in accordance with claim 1, further characterized in said separable members forming a vertically oriented reinforcing flap which is part of one of said first, second and third laminae at each of a pair of opposed corners of said liner.

* * * * *